US008720586B2

(12) United States Patent
Duong

(10) Patent No.: US 8,720,586 B2
(45) Date of Patent: May 13, 2014

(54) HYBRID SEAL

(75) Inventor: Khanh Anh Duong, Sugar Land, TX (US)

(73) Assignee: Vetco Gray Inc., Houston, TX (US)

( * ) Notice: Subject to any disclaimer, the term of this patent is extended or adjusted under 35 U.S.C. 154(b) by 210 days.

(21) Appl. No.: 13/174,060

(22) Filed: Jun. 30, 2011

(65) Prior Publication Data

US 2013/0000920 A1 Jan. 3, 2013

(51) Int. Cl.
*E21B 33/035* (2006.01)
*E21B 33/00* (2006.01)
*E21B 33/128* (2006.01)

(52) U.S. Cl.
USPC ..... 166/368; 166/336; 166/344; 166/348; 166/350; 277/337; 277/314

(58) Field of Classification Search
USPC ..... 166/336, 344, 348, 349, 350, 368, 382, 166/387, 84.1; 277/337, 314
See application file for complete search history.

(56) References Cited

U.S. PATENT DOCUMENTS

| | | | | |
|---|---|---|---|---|
| 4,665,979 A | | 5/1987 | Boehm, Jr. | |
| 4,714,111 A | | 12/1987 | Brammer | |
| 4,751,965 A | * | 6/1988 | Cassity | 166/182 |
| 4,759,409 A | * | 7/1988 | Gullion | 166/348 |
| 4,932,472 A | | 6/1990 | Boehm, Jr. | |
| 4,949,786 A | | 8/1990 | Eckert et al. | |
| 5,060,724 A | * | 10/1991 | Brammer et al. | 166/208 |
| 5,174,376 A | * | 12/1992 | Singeetham | 166/208 |
| 5,285,853 A | * | 2/1994 | Eckert et al. | 166/382 |
| 5,456,314 A | * | 10/1995 | Boehm et al. | 166/208 |
| 6,367,558 B1 | | 4/2002 | Borak, Jr. | |
| 7,762,319 B2 | * | 7/2010 | Nelson | 166/84.1 |
| 2008/0230229 A1 | * | 9/2008 | Shaw et al. | 166/368 |
| 2010/0116489 A1 | * | 5/2010 | Nelson | 166/182 |
| 2010/0126736 A1 | * | 5/2010 | Ellis et al. | 166/387 |
| 2011/0174506 A1 | | 7/2011 | Duong | |
| 2012/0098203 A1 | | 4/2012 | Duong | |

FOREIGN PATENT DOCUMENTS

GB 2485047 A 5/2012

OTHER PUBLICATIONS

GB Search Report dated Sep. 26, 2012 from corresponding Application No. GB1211506.9.

* cited by examiner

*Primary Examiner* — James Sayre
(74) *Attorney, Agent, or Firm* — Bracewell & Giuliani LLP

(57) ABSTRACT

A casing hanger seal assembly is lowered into a pocket between a casing hanger and a wellhead housing while in a run-in position. The seal assembly has a metal-to-metal upper seal ring and an elastomeric and metal lower seal ring carried by and below the upper seal ring. The upper and lower seal rings are movable from a run-in position to a set position sealing between the sidewalls of the casing hanger and the wellhead housing by applying a downward force. The downward force required to move the lower seal ring to the set position is less than the downward force required to move the upper seal ring to the set position. A downward force applied to the upper seal ring after the lower seal ring has landed in the pocket transfers to the lower seal ring to cause the lower seal ring to move to the set position before the upper seal ring moves to the set position.

13 Claims, 2 Drawing Sheets

HYBRID SEAL

FIELD OF THE DISCLOSURE

This disclosure relates in general to subsea wellhead seals, particular to a hybrid seal that has a metal-to-metal primary sealing portion and a secondary portion that serves as an emergency seal.

BACKGROUND

During creation of a subsea well, a wellhead assembly including a wellhead housing is located at the upper end of the wellbore at the sea floor. As the well is drilled deeper, a drill string passes through the wellhead housing. One or more casing strings are lowered through the wellhead housing, each supported with a casing hanger that lands in the bore of the wellhead housing. A packoff or casing hanger seal is set in a seal pocket between a side surface of the casing hanger and a sidewall of the bore. The casing hanger seal is preferably a metal-to-metal seal, which bests seals if the sealing surfaces on the casing hanger and on the sidewall of the bore are in good condition.

Wellhead drilling operations may cause damage to the sidewall of the wellhead housing bore before the casing hanger seal is installed. In particular, casing hangers and the high pressure wellhead housing can be damaged with scratches and gouges that range from minor scratches, such as a few thousandths deep, to major scratches, as much 0.1" deep. To seal a casing hanger annulus that has been damaged, it may be necessary that the seal is constructed of a compliant material that can extrude and fill the scratches and gouges. If the desired metal-to-metal seal is unable to seal adequately, it is normally removed and replaced with an emergency seal. Normally, emergency seals consisting of elastomeric seal elements are used to seal the casing hanger annulus. The emergency seal may also have metal sealing elements combined with the elastomeric element.

Retrieving a primary metal-to-metal seal that fails to meet a pressure test is a time-consuming task. The operator has to release the primary seal from its set condition and retrieve it with a string of drill pipe. The operator then has to run an emergency seal with a running tool on a string of drill pipe. In deep water, the cost to trip a string of drill pipe from the drilling vessel to the subsea wellhead housing is expensive.

SUMMARY

The seal assembly disclosed herein is designed to seal between inner and outer tubular members of a subsea wellhead assembly. The seal assembly includes a primary seal ring and a secondary seal ring. The primary and secondary seal rings are energized from a run-in to a set position by applying an energizing force. The energizing force required to move the secondary seal ring to the set position is less than the energizing force required to move the primary seal ring to the set position. After the seal assembly has landed between the inner and outer members, an energizing force applied to the primary seal ring transfers to the secondary seal ring to cause the secondary seal ring to move to the set position before the primary seal ring moves to the set position.

In the preferred embodiment, the primary seal ring has inner and outer annular legs that are separated from each other by an annular slot. An energizing ring with greater thickness than the slot is carried in a run-in position with its end engaging an entrance end of the slot. An energizing force supplied to the energizing ring, after the secondary seal ring has landed, initially transfers through the primary seal ring to the secondary seal ring, causing the secondary seal ring to move to the set position. A continuing force applied to the energizing ring after the secondary seal ring is in the set position pushes the energizing ring into the slot to move the primary seal ring to the set position.

Annular channels may be located on the inner side surface of the primary seal ring. An inlay of a metal softer than the metal of the primary seal ring is located within the channels. The primary seal ring has an annular force transferring leg that extends downward below these channels. The force transferring leg has a lower end that transfers setting force to the secondary seal ring.

The secondary seal ring preferably has a lower portion that provides sealing engagement with the inner and outer tubular members when the secondary seal ring is moved to the set position. An annular neck protrudes upwards from the lower portion alongside a side surface of the force transferring leg. A coupling device between the side surface of the force transferring leg and a side surface of the neck secures the secondary seal ring to the primary seal ring. The downward force supplied to the primary seal ring preferably does not pass through the coupling device.

A BRIEF DESCRIPTION OF THE DRAWINGS

DETAILED DESCRIPTION

Figure 1:
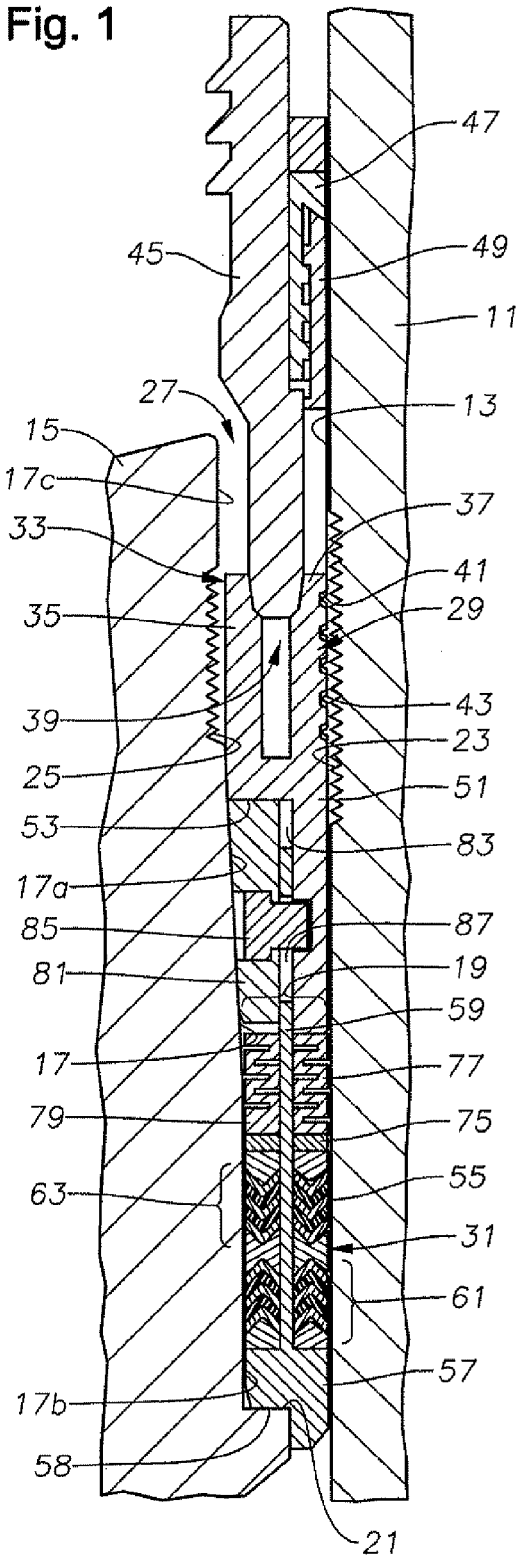
FIG. 1 is a sectional view showing a portion of casing hanger within a wellhead housing and a seal assembly constructed in accordance with this disclosure and shown in the run-in position.

Referring to FIG. 1, wellhead housing 11 is a tubular member that is located at the upper end of a well at the sea floor. Wellhead housing 11 has a bore with a sidewall 13. A casing hanger 15 is lowered into wellhead housing 11 and landed on a shoulder (not shown). A string of casing (not shown) attaches to a lower end of casing hanger 15. The casing is cemented in the well. Casing hanger 15 has an outer sidewall 17 that is spaced radially inward from bore sidewall 13. Outer sidewall 17 may have a central conical portion 17*a* that tapers downward to a cylindrical portion 17*b* of smaller diameter. A larger diameter cylindrical portion 17*c* extends upward from conical portion 17*b*. Bore sidewall 13 is typically cylindrical in this portion of wellhead housing 11. A seal pocket 19 is defined by the annular space between outer sidewall 17 and bore sidewall 13. Seal pocket 19 has a lower end defined by an upward facing shoulder 21 that is located on the exterior of casing hanger 15. Seal pocket 19 has a smaller radial width in the lower portion 17*b* of casing hanger 15 below conical portion 17*a* than in the upper portion 17*c* above conical portion 17*a*.

In this example, wellhead housing 11 has a set of wickers 23 located on bore sidewall 13. Additionally, casing hanger 15 may have a set of wickers 25 spaced directly across from wickers 23 on cylindrical portion 17*c*. Wickers 23 and 25 comprise small circumferential grooves extending around their respective surfaces. Normally, wickers 23 and 25 will have a saw tooth shape when viewed in cross section.

A seal assembly 27 is shown in a run-in position being lowered into seal pocket 19 prior to being set. Seal assembly 27 has an upper seal ring 29 and a lower seal ring 31. Upper seal ring 29 is a primary seal ring, and lower seal ring 31 is an auxiliary seal ring in this embodiment. Upper seal ring 29 has an upper portion 33 that sealingly engages wickers 23 and 25 when in the set position. Upper portion 33 has an inner leg 35 and an outer leg 37, both being annular, cylindrical members separated from each other by an annular slot 39. In this example, several annular channels 41 are formed on the outer diameter of outer leg 37. Channels 41 are axially separated from each other and are in planes perpendicular to the axis of bore sidewall 13. An inlay 43 of a soft metal alloy is located within each of the channels 41. In the preferred embodiment, inlay 43 comprises an alloy of tin and indium. When in the set position, inlay 43 will imbed into wickers 23 to enhance sealing. The material of inlay 43 is softer than the material of seal ring 29, which is typically formed of a steel alloy.

An energizing ring 45 serves to move upper seal ring 29 to the set position. Energizing ring 45 is engaged by a running tool (not shown) to lower seal assembly 27 into seal pocket 19 after casing hanger 15 has been cemented. The running tool also will apply a downward force to energizing ring 45 and upper seal ring 29 to energize lower seal ring 31. Continuing the downward force at a higher level will then energize upper seal ring 29. Energizing ring 45 has a radial thickness that is greater than the radial dimension of slot 39. In the run-in position, the lower end of energizing ring 45 is located at the upper end or entrance of slot 39 in abutment with upper ends of both legs 35, 37. When setting lower seal ring 31, energizing ring 45 remains in engagement with the upper ends of legs 35, 37. When setting upper seal ring 29, energizing ring 45 will extend into slot 39 a considerable distance, forcing inner leg 35 inward and outer leg 37 outward. The radial deformation of inner leg 35 and outer leg 37 exceeds the yield strength of the material of upper seal ring 29. Energizing ring 45 is secured to seal assembly 27 by a retainer ring 47 that has mating threads that engage threads on an upper extension 49 of outer leg 37.

Upper seal ring 29 has a force transfer leg 51 that extends downward from upper portion 33. Forced transfer leg 51 extends below the junction of inner leg 35 with outer leg 37 and in this example is aligned with outer leg 37. The outer diameter of force transfer leg 51 is approximately the same as the outer diameter of outer leg 37. The inner diameter of force transfer leg 51 is approximately the same as the inner diameter of outer leg 37. The thickness of force transfer leg 51 is thus considerably smaller than the radial dimension of seal upper portion 33 measured from the inner diameter of inner leg 35 to the outer diameter of outer leg 37. The difference in radial thickness results in a downward facing shoulder 53 at the lower end of upper portion 33 of upper seal ring 29. Force transfer leg 51 serves to set lower seal ring 31.

Figure 2:
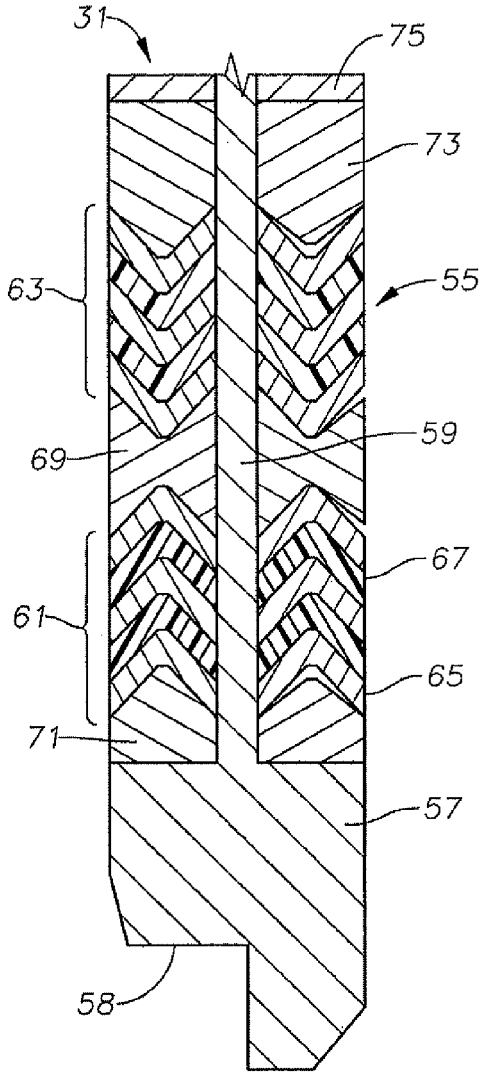
FIG. 2 is an enlarged view of the lower portion of the lower seal ring of the seal assembly of FIG. 1.

Lower seal ring 31 has a lower portion 55 that is at least partially elastomeric/thermoplastic and is deformed radially inward and outward to seal between casing hanger 15 and wellhead housing 11. Lower portion 55, better shown in FIG. 2, has a nose 57 on its lower end. Nose 57 has a downward facing shoulder 58 that lands on upward facing shoulder 21 (FIG. 1). A vertical cylindrical dividing wall 59 extends upward from nose 57 concentric with bore sidewall 13. Vertical dividing wall 59 is located an equal distance between the inner diameter and the outer diameter of nose 57. A lower sealing ring set 61 has seal rings located both on the inner diameter and the outer diameter of vertical dividing wall 59. An upper sealing ring set 63 is located above lower sealing ring set 61 and has seal rings both on the inner and outer diameters of dividing wall 59. Each sealing ring set 61, 63 is made up of V-shaped metal rings 65 and V-shaped elastomeric/thermoplastic rings 67. Metal rings 65 and elastomeric/thermoplastic rings 67 alternate with one another and are stacked on each other. The number can vary, and in this example, each set 61, 63 comprises three metal rings 65 and two elastomeric/thermoplastic rings 67 on the inner diameter and the same number on the outer diameter of dividing wall 59. In this example, rings 65, 67 of lower sealing ring set 61 face downward, and rings 65, 67 of upper sealing ring set 63 face upward. Horizontal dividing rings or spacers 69 separate lower sealing ring set 61 from upper sealing ring set 63. Horizontal spacers 69 have concave V-shaped recesses on both the upper and lower sides. Metal lower end rings 71 are located at the lower ends of the lower sealing ring set 61. Metal upper end rings 73 are located at the upper end of upper sealing ring set 63. Each end ring 71, 73 is flat on one end and V-shaped on the other end. Flat washers or spacers 75 may be located above upper end rings 73. When a downward force of sufficient magnitude is applied to spacers 75, seal ring sets 61, 63 move axially relative to dividing wall 59 and deflect radially outward and inward to seal between dividing wall 59, casing hanger 15 and wellhead housing 11.

Referring to FIG. 1, an outer spring member 77 may be located on the outer side of dividing wall 59 in contact with the outer spacer ring 75. Similarly, an inner spring member 79 may be located on the inner spacer ring 75. In this example, outer spring member 77 is abutted by the lower end of force transfer leg 51. Each spring member 77, 79 in this example comprises a cylinder that has slits on its inner and outer diameters that alternate with each other to allow resilient axial deflection. Outer spring member 77 has a greater axial dimension than inner spring member 79 in this example to accommodate different setting strokes between sealing rings sets 61, 63 on the inner side of dividing wall 59 and those on the outer side of dividing wall 59.

A neck 81 extends upward from the upper end of inner spring member 79. In this example, neck 81 is a cylindrical ring that is formed separate from inner spring member 79. Neck 81 has an upper end that is in substantial abutment with downward facing shoulder 53. Neck 81 extends alongside and within the inner diameter of force transfer leg 51. The outer diameter of neck 81 is less than the inner diameter of force transfer leg 51, creating a cylindrical gap 83. Vertical dividing wall 59 extends upward within gap 83.

A coupling device, which is in this example comprises a threaded fastener 85, extends through a circular hole in neck 81 outward into a threaded receptacle in the inner diameter of force transfer leg 51. Fastener 85 extends through gap 83 and also through an elongated aperture 87 in vertical dividing wall 59. Fastener 85 thus secures lower seal ring 31 to force transfer leg 51. Neck 81 and force transfer leg 51 will be able to move downward relative to vertical wall 59 because of elongated aperture 87. The downward force passing through force transfer leg 51 and neck 81 does not pass through fastener 85 because neck 81 and force transfer leg 51 move downward in unison. The radial width of seal assembly 27 measured from an inner diameter of neck 81 to an outer diameter of force transfer leg 51 is no greater than a run-in radial width of upper seal ring 29. The radial width from the inner diameter of neck 81 to the outer diameter of force transfer leg 51, measured at the upper end of neck 81, is greater in this example than the radial width of the lower portion 55 of lower seal ring 31.

In operation, after casing hanger 15 has been installed within wellhead housing 11 and the casing cemented in place, the operator will install seal assembly 27. The operator actuates the casing hanger running tool (not shown) to lower seal assembly 27 into seal pocket 19. Nose 57 will land on shoulder 21. The running tool applies a downward force to energizing ring 45, which transfers the force to inner and outer legs 35, 37 of upper seal ring 29. The force to move inner and outer legs 35, 37 to the set position is considerably greater than the force required to move lower seal ring 31 to the set position. Consequently, this force applied by energizing ring 45 will initially pass through neck 81 and force transfer leg 51 through spring members 79, 77 to lower seal ring 31. Once the downward force is at a level sufficient to cause radial deformation of sealing ring sets 61, 63, upper end rings 73 will begin moving downward relative to nose 57 and vertical dividing wall 59. This downward movement causes metal rings 65 and elastomeric/thermoplastic rings 67 to deflect and move toward a flatter position. Edges of the metal rings and elastomeric/thermoplastic rings 65, 67 will sealingly engage casing hanger wall 17*b* and wellhead housing bore wall 13. Sealing engagement is also formed by the edges of rings 65, 67 on the inner and outer diameters of vertical dividing wall 59. Spring members 77 and 79 will contract in length and maintain a bias force against lower seal ring 31.

Once lower seal ring 31 is in the set position, the force required by the running tool will, increase. Continued application of the downward force at a greater level will move energizing ring 45 into slot 39. This results in inner leg 35 deflecting inward and outer leg 37 expanding outward, sealing against wickers 25 and 23. Wickers 23 and 25 do not extend significantly upward or downward from upper seal ring 29. In the preferred embodiment, lower seal ring 31 seals against smooth bore portions of casing hanger wall 17*b* and bore wall 13. The engagement of upper seal ring 29 with wickers 23, 25 also serves as a lock down to maintain lower seal ring 31 in the set position. Neck 81, spring members 77, 79 and a lower portion of force transfer leg 51 are located adjacent casing hanger conical portion 17*a*.

When pressure tested, lower seal ring 31 assists in preventing leakage past upper seal ring 29. If upper seal ring 29 forms a good metal-to-metal seal, lower seal ring 31 will have no function. However, if upper seal ring 29 fails to seat properly due to damage to the sealing surfaces, the emergency seal provided by lower seal ring 31 will assist in allowing a good pressure test to occur. It should not be necessary to retrieve seal assembly 27 and return with an emergency seal.

Figure 3:
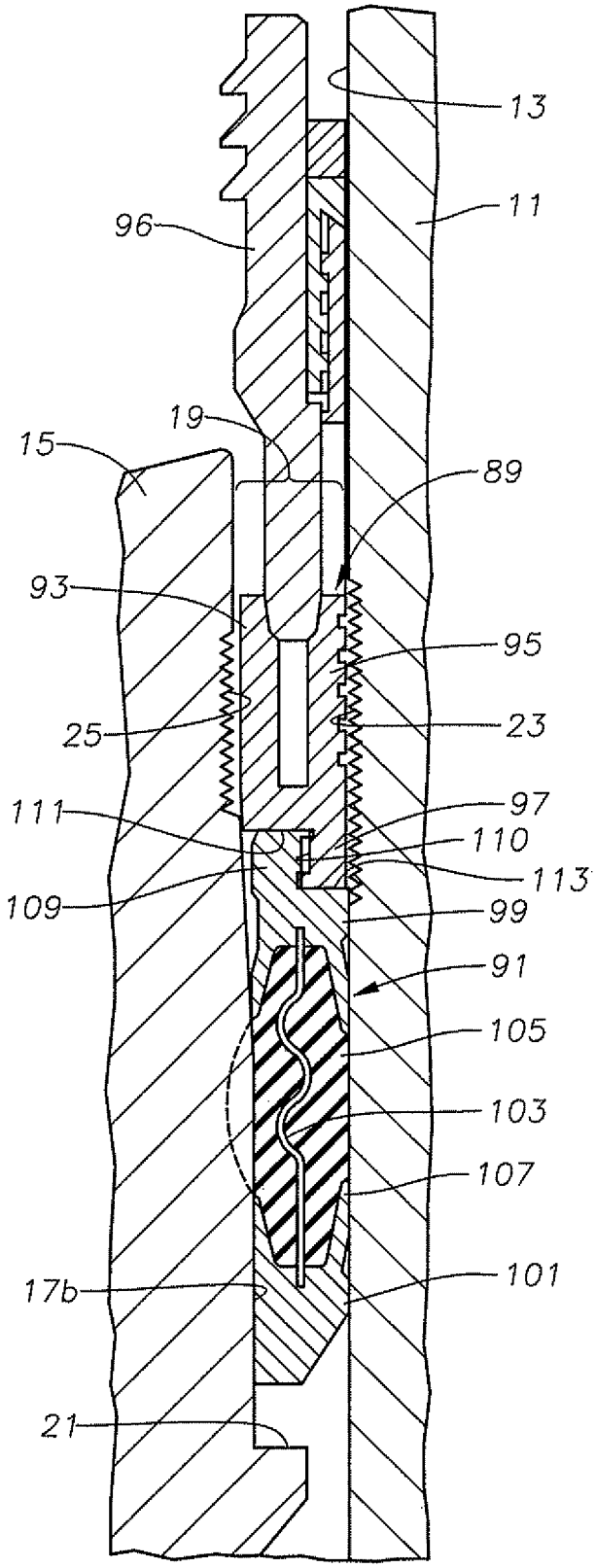
FIG. 3 is a sectional view showing a portion of a casing hanger within a wellhead housing and an alternate embodiment of a seal assembly constructed in accordance with this disclosure, shown in the run-in position.

Various other types of auxiliary seal rings can be utilized. For example, rather than inner and outer sets of seal rings separated by vertical dividing wall, a single set of V-shaped metal and elastomeric/thermoplastic rings could be employed. Also, an entirely different type of lower seal may be employed as shown in FIG. 3. The numerals identifying features of casing hanger 15 and wellhead housing 11 are the same as in FIG. 1. In the embodiment of FIG. 3, upper seal ring 89 is similar to upper seal ring 29 of FIG. 1. A lower seal ring 91 that is partly elastomeric is secured to and below upper seal ring 89. Upper seal ring 89 has an inner leg 93 and an outer leg 95, both of metal and separated from each other by a slot as in the first embodiment. A cylindrical force transfer leg 97 extends downward from upper seal ring 89. Force transfer leg 97 is also located on an outer diameter of upper seal ring 89 in this embodiment.

Lower seal ring 91 has an upper ring 99 of metal and a nose ring 101 also of metal. A flexible annular band 103 extends between upper ring 99 and nose ring 101, securing nose ring 101 to upper ring 99. Flexible band 103 is embedded within a central portion of an elastomer band 105 and is capable of changes in axial distance between upper ring 99 and nose ring 101. Elastomeric band 105 has a rim-in radial thickness that is initially greater than the radial thickness of seal pocket 27 as indicated by the dotted lines. When pushed into pocket 27, elastomeric band 105 will deform. A downward force of upper ring 99 against elastomeric band 105 after nose 101 has landed on shoulder 21 will push upper ring 99 toward nose ring 101 to cause elastomeric band 105 to seal between casing hanger surface 17*b* and bore wall 13. Preferably, upper ring 99 and nose ring 101 have metal lips 107 that face toward each other. An outer one of the metal lips 107 will seal and engage the inner wall of wellhead housing 11. An inner one of each of the metal lips 107 will seal and engage casing hanger outer sidewall 17*b*. As in the first embodiment, lower seal ring 91 is spaced below wickers 23, 25.

A neck 109 protrudes upward from upper ring 99 alongside and within the inner diameter of force transfer leg 97. A coupling device to secure neck 109 to force transfer leg 97 comprises threads 110 in this example. A downward facing shoulder 111 abuts an upper end of neck 109. The lower end of force transfer leg 97 abuts an upward facing shoulder 113, which is located outward of neck 109. The radial width from an inner diameter of neck 109 to an outer diameter of force transfer leg 99 is no greater than a run-in radial width of upper seal ring 89 or lower seal ring 91.

As in the first embodiment, the force required to set lower seal ring 91 is less than the force required to set upper seal ring 89. Consequently, the downward force of the running tool applied to energizing ring 96 will cause lower seal ring 91 to set first. Continued application of a downward force, but at a greater level, will then force inner and outer legs 93, 95 apart to set upper seal ring 89. Preferably, the downward force of energizing ring 96 does not pass through threads 110, rather passes directly to lower seal ring 91 because of the abutment of downward facing shoulder 111 with neck 109 and the abutment of force transfer leg 97 with shoulder 113.

While this disclosure has been shown only two of its forms, it should be apparent to those skilled in the art that it is not so limited but it susceptible to various changes without departing from the scope of disclosure.

The invention claimed is:

1. A seal assembly for sealing in a seal pocket between inner and outer tubular members of a subsea wellhead assembly, comprising:

a metal-to- metal primary seal ring having an axis , the primary seal ring having an upper portion for sealing between the inner and outer tubular members and an annular force transferring leg extending downward from the upper portion;

a secondary seal ring having an upward extending neck extending alongside and secured to the leg, the secondary seal ring having elastomeric and metal sealing surfaces and an upward facing shoulder that is engaged by a lower end of the leg; and the primary and secondary seal rings being energized from a run-in to a set position by applying a downward directed energizing force to the seal assembly, which causes the secondary seal ring to move to the set position before the primary seal ring moves to the set position; and wherein the energizing force has a load path from the lower end of the leg through the upward facing shoulder of the secondary seal ring, bypassing the neck.

2. The seal assembly according to claim 1, wherein the primary seal ring comprises:

annular inner and outer legs separated from each other by an annular slot having a run-in radial width;

an energizing ring having a radial thickness greater than the run-in radial width and carried in a run-in position with an end engaging an entrance of the annular slot; and wherein the energizing force is applied to the energizing ring.

3. The seal assembly according to claim 1, wherein:

the neck and the leg are cylindrical and concentric walls connected to each other by a coupling device that is bypassed by the load path.

4. The seal assembly according to claim 1, wherein the secondary seal ring further comprises:

a metal, resilient spring element through which the load path passes.

5. The seal assembly according to claim 4, wherein the spring element is located above the portion of the secondary seal containing the elastomeric and metal seal surfaces.

6. The seal assembly according to claim 4, wherein the spring element comprises a cylinder having circumferentially extending inner slits formed on an inner diameter and circumferentially extending outer slits formed on an outer diameter of the cylinders, the inner slits alternating with the outer slits in an axial direction.

7. The seal assembly according to claim 1, wherein a combined radial width of the neck and the force transferring leg is no greater than a radial width of the upper portion of the primary seal ring measured in the run-in position.

8. The seal assembly according to claim 1, wherein:

the upper portion of the primary seal ring has a downward facing shoulder on a lower end of the upper portion; and the neck has an upper end that is in abutment with the downward facing shoulder when the secondary seal ring is in the set position.

9. A subsea wellhead assembly, comprising:

an outer wellhead housing having a bore;

a casing hanger landed within the bore, defining an annular pocket between a sidewall of the casing hanger and a sidewall of the bore, the casing hanger having an external shoulder that defines a lower end of the pocket;

a seal assembly that is lowered into the pocket while in a run-in position, the seal assembly having elastomeric and metal seal surfaces that are deformed into sealing engagement with the casing hanger and the sidewall of the bore when the seal assembly is in a set position;

the seal assembly being movable from a run-in position to the set position by applying a downward force;

a resilient, metal spring element that exerts an axial force on the seal assembly after the seal assembly position; and wherein:

the spring element comprises a cylinder having circumferentially extending inner slits formed on an inner diameter and circumferentially extending outer slits formed on an outer diameter of the cylinder, the inner slits alternating with the outer slits in an axial direction.

10. A method of sealing between inner and outer tubular members of a subsea wellhead assembly, comprising:

(a) providing a metal-to-metal primary seal ring of a type that expands radially inward and outward, relative to an axis of the primary seal ring, in response to an axially directed primary setting force relative to an axis of the primary seal ring, and providing the primary seal ring with a downward extending leg;

(b) providing a secondary seal ring having metal and elastomeric sealing surfaces that expand radially inward and outward in response to an axially directed secondary setting force that is less than the primary setting force, and providing the secondary seal ring with an upward extending neck that extends alongside the leg;

(c) securing the neck of the secondary seal ring to the leg of the primary seal ring to define a seal assembly;

(d) lowering the seal assembly between the inner and outer tubular members;

(e) applying a first axially directed force to the primary seal ring that is at least equal to the secondary setting force, causing the secondary seal ring to radially expand inward and outward to sealingly engage the inner and outer tubular members, the first axially directed force extending down the leg to the elastomeric and metal sealing surface portion of the secondary seal, bypassing the neck; then (f) applying a second axially directed force to the primary seal ring that is at least equal to the primary setting force, causing the primary seal ring to radially expand inward and outward to sealingly engage the inner and outer tubular members.

11. The method according to claim 10, wherein:

step (c) comprises employing a coupling device to connect the neck of the secondary seal ring to the leg of the primary seal ring; and steps (d) and (e) comprise transferring the first and second axially directed forces to the secondary seal ring without any portion of the first and second axially directed forces passing through the coupling device.

12. The method according to claim 10, wherein:

a set of wickers is located on at least one of the tubular members;

during step (e), the secondary seal ring engages the inner and outer tubular members at an area below the set of wickers; and the primary seal ring engages the set of wickers during step (f).

13. The method according to claim 10, wherein step (c) further comprises positioning a metal, resilient spring element against an end of the secondary seal ring; and the method further comprises:

in step (e) contracting the spring element in response to the first axially directed force; and exerting an axially directed spring force from the spring element to the secondary seal ring after the secondary seal ring has been set.

* * * * *

UNITED STATES PATENT AND TRADEMARK OFFICE

CERTIFICATE OF CORRECTION

PATENT NO. : 8,720,586 B2
APPLICATION NO. : 13/174060
DATED : May 13, 2014
INVENTOR(S) : Duong et al.

It is certified that error appears in the above-identified patent and that said Letters Patent is hereby corrected as shown below:

Title Page, Item (12) delete "Duong" insert --Duong et al.--.

Title Page, Item (75) Inventor, should read

--(75) Inventors: Khanh Anh Duong, Houston, TX (US); Gary L. Galle, Houston, TX (US)--.

Signed and Sealed this
Twenty-second Day of March, 2016

Michelle K. Lee

Michelle K. Lee
*Director of the United States Patent and Trademark Office*